US009578403B2

(12) United States Patent
Lim

(10) Patent No.: US 9,578,403 B2
(45) Date of Patent: Feb. 21, 2017

(54) 2-WAY SPEAKER WITH COAXIAL EFFECT

(71) Applicant: Chang-Soo Lim, Seoul (KR)

(72) Inventor: Chang-Soo Lim, Seoul (KR)

( * ) Notice: Subject to any disclaimer, the term of this patent is extended or adjusted under 35 U.S.C. 154(b) by 0 days.

(21) Appl. No.: 14/913,342

(22) PCT Filed: Aug. 20, 2014

(86) PCT No.: PCT/KR2014/007707
§ 371 (c)(1),
(2) Date: Feb. 19, 2016

(87) PCT Pub. No.: WO2015/026145
PCT Pub. Date: Feb. 26, 2015

(65) Prior Publication Data

US 2016/0205466 A1 Jul. 14, 2016

(30) Foreign Application Priority Data

Aug. 20, 2013 (KR) ..... 10-2013-0098773

(51) Int. Cl.
*H04R 1/28* (2006.01)
*H04R 1/02* (2006.01)
*H04R 1/24* (2006.01)
*H04R 1/26* (2006.01)

(52) U.S. Cl.
CPC ..... *H04R 1/023* (2013.01); *H04R 1/24* (2013.01); *H04R 1/26* (2013.01); *H04R 1/2896* (2013.01)

(58) Field of Classification Search
CPC ..... H04R 1/00; H04R 2205/022; H04R 2201/401; H04R 2201/405; H04R 1/28; H04R 1/2869; H04R 1/2873; H04R 1/2876
USPC ..... 381/345–347, 353–354, 182
See application file for complete search history.

(56) References Cited

U.S. PATENT DOCUMENTS 4,283,606 A 8/1981 Buck
4,365,114 A 12/1982 Soma
2005/0276436 A1 12/2005 Kobayashi et al.

FOREIGN PATENT DOCUMENTS

KR 20-1999-0010587 U 3/1999

*Primary Examiner* — Suhan Ni
(74) *Attorney, Agent, or Firm* — John K. Park; Park Law Firm

(57) ABSTRACT

A speaker design technology acquires a coaxial effect of an output sound by placing a high-frequency speaker for outputting a high-pitched sound apart from a low-frequency speaker for outputting a low-pitched sound by a predetermined distance and mechanically arranging output points of the high-frequency speaker and the low-frequency speaker in alignment with each other. The speaker design technology lets vibration of a low-frequency speaker to avoid interference by the high-frequency speaker and also lets the high-frequency speaker to avoid interference by the vibration of the low-frequency speaker by arranging the high-frequency speaker in front of a dust cap necessarily installed in the center of the low-frequency speaker. Since the high-frequency speaker and the low-frequency speaker are spaced apart from each other so as to independently operate, any interface is not required for enabling the high-frequency and the low-frequency speakers to interwork with each other.

6 Claims, 10 Drawing Sheets

2-WAY SPEAKER WITH COAXIAL EFFECT

FIELD OF THE INVENTION

The present invention relates to a speaker design technology which acquires a coaxial effect of an output sound by placing a high-frequency speaker for outputting a high-pitched sound apart from a low-frequency speaker for outputting a low-pitched sound by a predetermined distance and mechanically arranging output points of the high-frequency speaker and the low-frequency speaker in alignment with each other.

More particularly, the present invention relates to a speaker design technology which lets vibration of a low-frequency speaker to avoid interference by the high-frequency speaker and also lets the high-frequency speaker to avoid interference by the vibration of the low-frequency speaker by arranging the high-frequency speaker in front of a dust cap necessarily installed in the center of the low-frequency speaker so as to be spaced apart each other by a specific distance.

BACKGROUND ART

In general, sound is initially recorded by a microphone and then is reproduced by speakers. When sound data is reproduced by speakers, treble sound and bass sound can be separated to output, which enables a user to preferably adjust volumes of treble sound and bass sound.

However, as shown in FIG. 1, the conventional speakers has employed a 2-way structure in which treble sound (a high-frequency speaker; 20) and bass sound (a low-frequency speaker; 10) are reproduced in separate channels. This 2-way structure has an advantage that volumes of treble sound and bass sound may be selectly adjusted. However, because treble and bass sounds are reproduced in separate channels, a single tone is output in different position. Therefore, this structure has disadvantage that sound reproduction is inaccurate.

For example, an orchestra performance may be recorded by a single microphone. Because the recording is done in a single channel (i.e., a single position of recording), its reproduction may preferably provide a natural sense of presence when the reproduced sound is output via a single channel (i.e., a single position of sound output). However, in the 2-way structure, the sound reproduction is inaccurate by sound output in two channels, which renders the sense of presence be poor.

In order to overcome these disadvantages, there is disclosed a coaxial speaker technology in which a high-frequency speaker for treble sound and a low-frequency speaker for bass sound may be incorporated in a coaxial line.

The conventional coaxial speaker adopts special mechanical design of different structures other than typical 2-way speakers because the high-frequency and low-frequency speakers are connected to interoperate each other. Accordingly, the conventional coaxial speaker has disadvantage of high production costs. In addition, the conventional coaxial speaker has further disadvantage of poor extra-bass reproduction because the low-frequency speaker which vibrates with outputting bass sound is under the influence of high-frequency speaker in a coaxial line.

The list of reference documents for the present invention may be as below.

1. Coexial speaker (KR patent application No. 10-2007-0080525)

2. Coexial speaker (KR patent application No. 10-2007-0035577)
3. Speaker device (US patent publication No. US 2005/0276436 A1)
4. Automotive loudspeaker having variable speaker orientation and particular electrical connections (U.S. Pat. No. 4,365,114 B)
5. Speaker device (US patent publication No. US 2005/0276436 A)

DISCLOSURE OF INVENTION

Technical Problem

It is an object of the present invention to provide a two-way speaker with coaxial effect which may provide coaxial effect of a high-frequency speaker and a low-frequency speaker with minimizing the interference therebetween by placing the high-frequency and the low-frequency speakers being coaxially aligned and being spaced apart from each other so as to independently operate.

Technical Solution

In order to achieve the object, a 2-way speaker with coaxial effect of the present invention comprises: a low-frequency speaker including a vibration plate being formed of disk shape with its central portion recessed to the rear and for outputting bass sound to the front, a dust cap 12 being fitted in the front central portion of the vibration plate so as to block the inside of the vibration plate from the outside, and a surround portion 13 of protruding to the front in a donut shape along the front rim of the vibration plate and for outputting surround-sound; a high-frequency speaker for outputting treble sound to the front in the center of the vibration plate and of being placed at a predetermined distance away from the front state of the dust cap so as to operate independently of the low-frequency speaker by which the interference in the vibration of bass sound from the vibration plate is minimized; a protector of being placed at a predetermined distance away from the front state of the dust cap so as to hold the high-frequency speaker 20 from the rear and of being formed to open the front side of the vibration plate by which the interference in the bass sound from the vibration plate being minimized.

Further, the protector comprises a holder portion for holding the high-frequency speaker with surrounding the high-frequency speaker 20 from the front, a plurality of bridge portions of protruding radially from a side of the holder portion with having one end being connected integrally with the side of the holder portion, a rim ring being connected integrally to the other end of the bridge portion and being close to the front rim of the vibration plate so as to anchor the holder portion to the vibration plate. It is preferable that the diameter of the holder portion is formed no greater than the diameter of the dust cap.

Further, the bridge portion may be made in a type of plate, and are arranged in thin and erected manner to the longitudinal direction of the vibration plate. Further, the bridge portion may be configured of a folded plate-shape with letting the power line leading to the high-frequency speaker to be sandwiched between the plates.

Further, a through hole may be formed in the inner longitudinal section along the bridge portion and the power supply line leading to the high-frequency speaker may be fitted in the through hole. Further, it is preferable that the bridge portion has the rear end corresponding to the surround portion being cut to the front by a predetermined depth.

Advantageous Effects

The 2-way speaker with coaxial effect of the present invention may provide advantages as set below.

(1) The high-frequency speaker is placed coaxially to the low-frequency speaker so that sound is accurately reproduced by coaxial effect of treble and bass sounds.

(2) Since the high-frequency and low-frequency speakers operate independently by the spacing, each of the speakers may be independently designed for optimum which let the problem of optimal design be eased.

(3) Because the high-frequency speaker and the low-frequency speaker are spaced apart from each other so as to independently operate, any interface is not required for enabling the high-frequency and the low-frequency speakers to interwork with each other, thereby significantly reducing production costs in comparison with the conventional coaxial speaker.

(4) By incorporating a protector which opening the front side of the vibration plate, the high-frequency speaker and the low-frequency speaker may be spaced so as to independently operate and the interference by bass sound of the low-frequency speaker may be minimized with holding the high-frequency speaker.

EMBODIMENT FOR CARRYING OUT THE INVENTION

The present invention is described below in detail with reference to the drawings.

Figure 1:
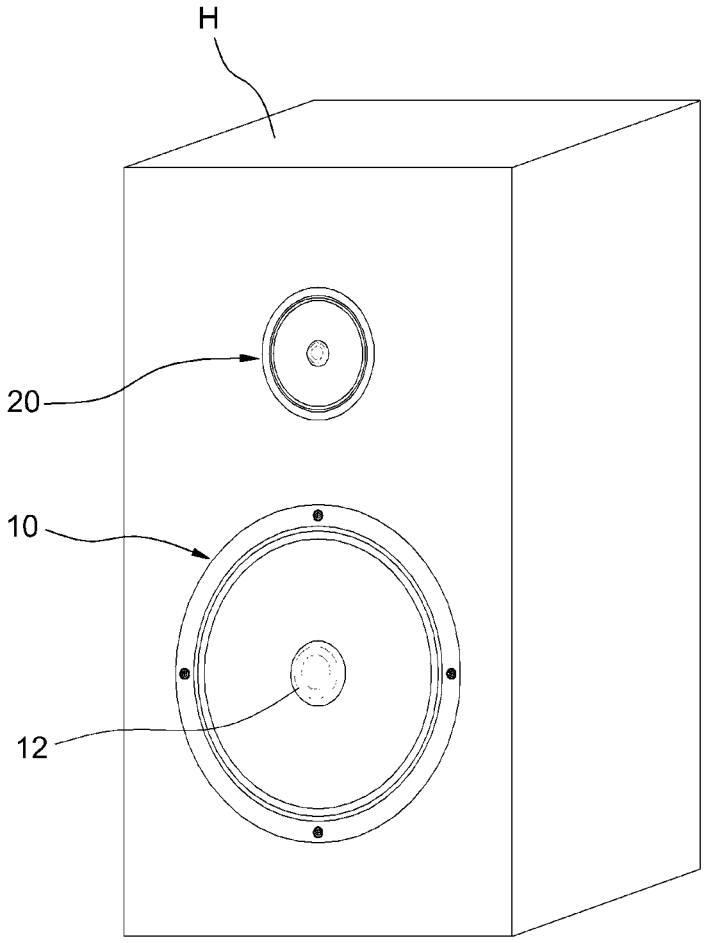
FIG. 1 shows an example of a conventional 2-way speaker.
Figure 2:
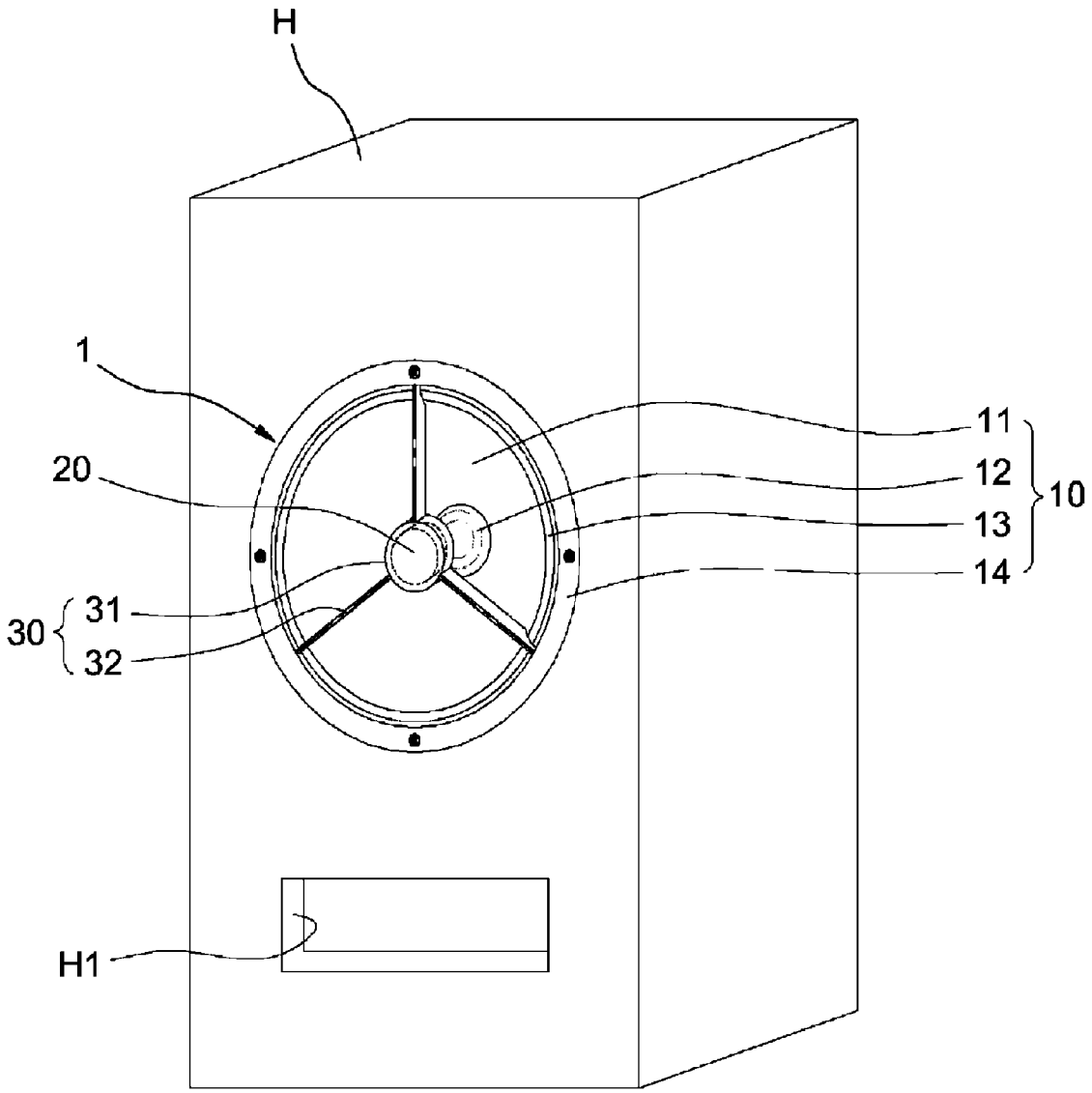
FIG. 2 shows a usage state of the 2-way speaker with coaxial effect according to a first embodiment of the present invention.

FIG. 2 shows a usage state of the 2-way speaker with coaxial effect according to a first embodiment of the present invention.

Referring to FIG. 2, the 2-way speaker 1 with coaxial effect may have smaller housing H than conventional 2-way speakers by coaxially disposing the low-frequency speaker 10 and the high-frequency speaker 20 in front of the housing H. The coaxial disposition of the low-frequency speaker 10 and the high-frequency speaker 20 results in space-saving. Then, a base port H1 may be formed in the front of the housing H. The base port H1 is a hole for wind of bass sound, which is generated when the low-frequency speaker 10 operates.

Figure 3:
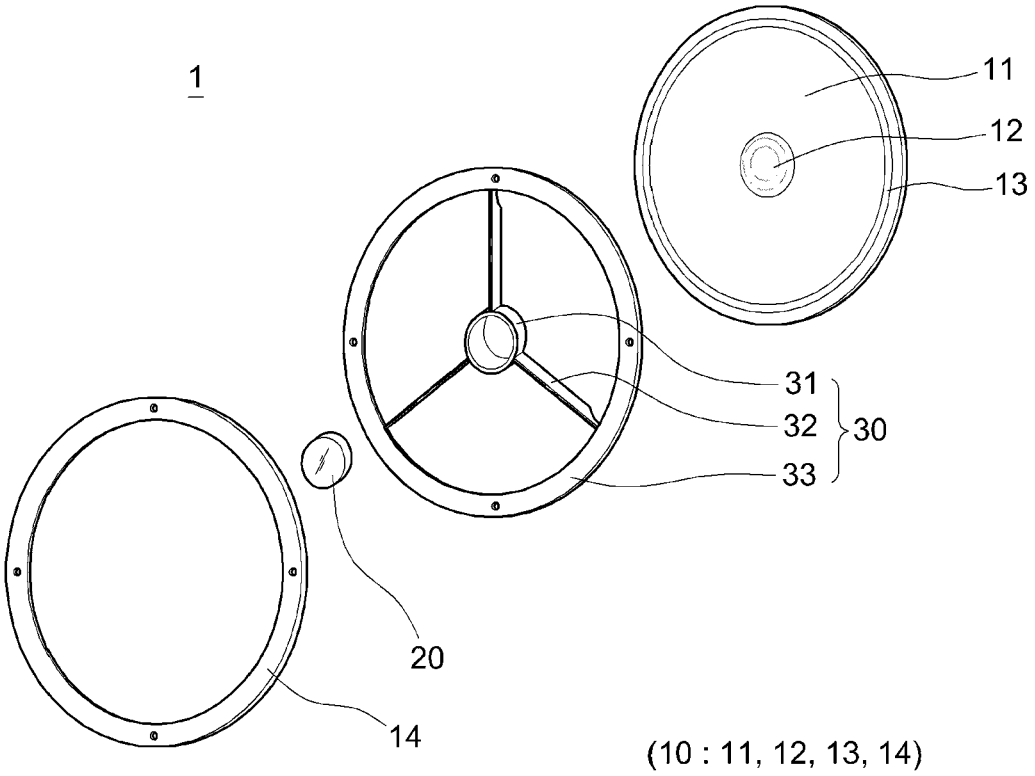
FIG. 3 is an exploded perspective view of the 2-way speaker with coaxial effect according to the first embodiment of the present invention.
Figure 4:
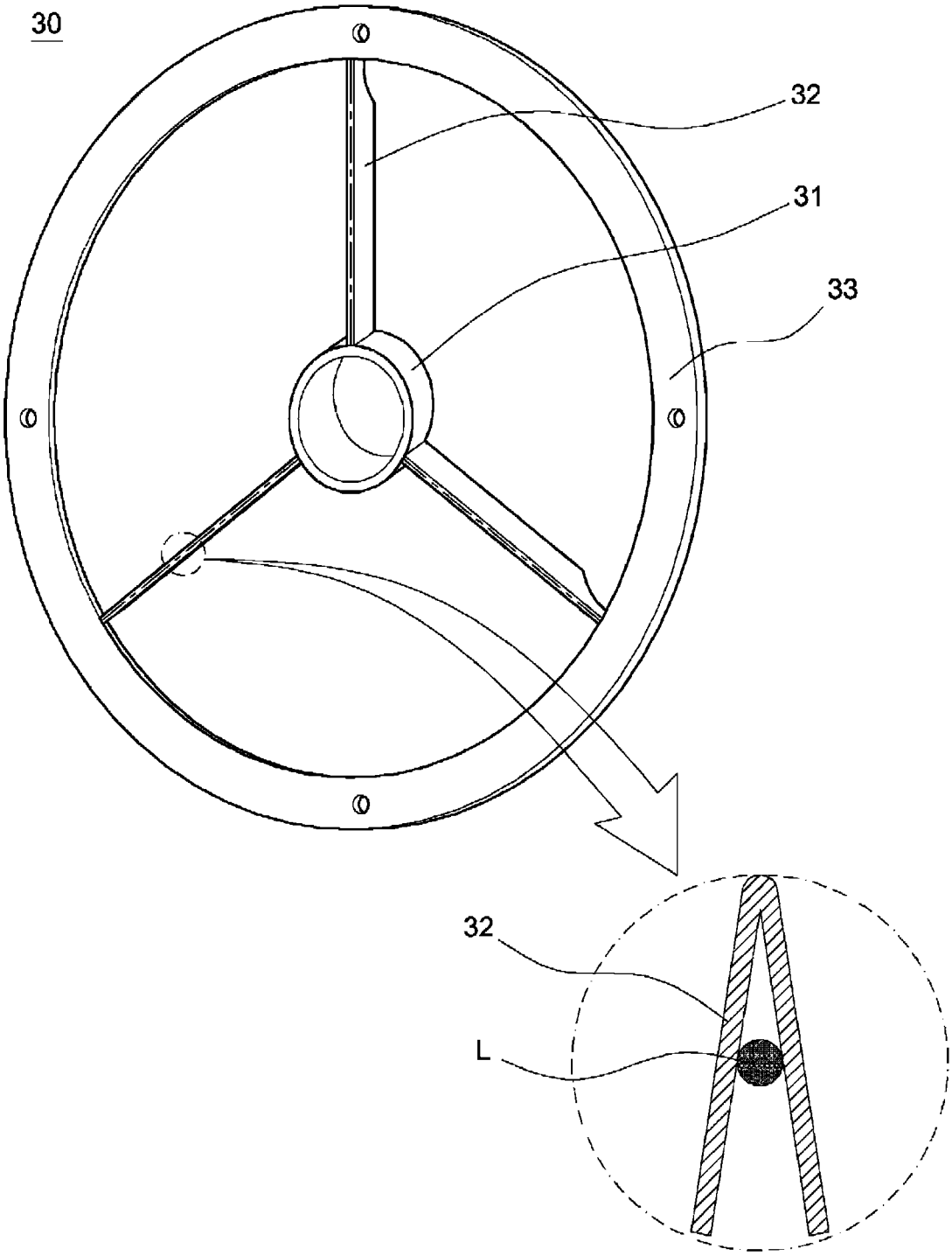
FIG. 4 shows a perspective view and an enlarged view of a part of a protector according to the first embodiment of the present invention.
Figure 5:
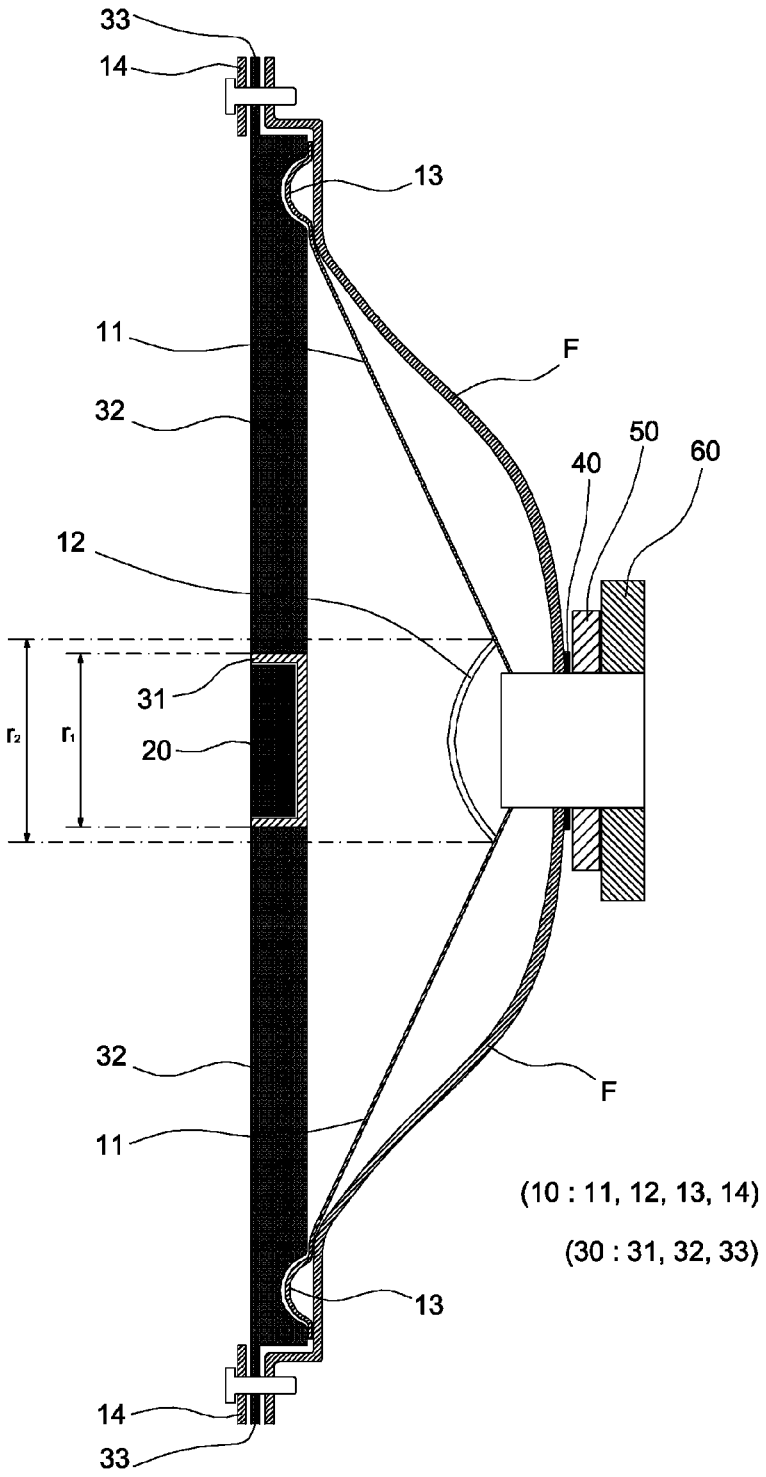
FIG. 5 is a cross-sectional side view of the 2-way speaker with coaxial effect according to the first embodiment of the present invention.

FIG. 3 is an exploded perspective view of the 2-way speaker with coaxial effect according to the first embodiment of the present invention. FIG. 4 shows a perspective view and an enlarged view of a part of a protector according to the first embodiment of the present invention. FIG. 5 is a cross-sectional side view of the 2-way speaker with coaxial effect according to the first embodiment of the present invention.

Referring to FIGS. 3 to 5, the 2-way speaker with coaxial effect according to the first embodiment of the present invention comprises a low-frequency speaker 10, a high-frequency speaker 20, and a protector 30.

First, the low-frequency speaker 10 generates bass sounds in a form of vibration, and comprises a vibration plate 11, a dust cap 12, a surround portion 13, a low-frequency speak ring 14. In this embodiment, the low-frequency speaker 10 may be implemented by adopting any one of a woofer outputting sound of low-frequency band or a midrange outputting sound of mid-frequency band.

The vibration plate 11 is formed of disk shape with its central portion being recessed to the rear, and vibrates in the longitudinal direction so as to output bass sound to the front. The vibration of the vibration plate 11 is made in association with the longitudinal vibration of the voice coil 40 which is disposed in the rear of the vibration plate 11. Further, the vibration of the voice coil 40 is made in association with electromagnetic force by a magnet 60, which is disposed in the rear of the voice coil 40.

The dust cap 12 is attached to the front of the recessed central portion of the vibration plate 11, and blocks dust which is flowing into inside of the 2-way speaker 1 in the back of the vibration plate 11. The vibration plate 11 may have a cut portion in central portion so as to provide connection to inner parts. The dust cap 12 blocks dust or particles from being drawn into inside of the speaker 1. The central portion of the vibration plate 11 to which the dust cap 12 is attached is a zone where sound wave for bass sound does not generate.

The high-frequency speaker 20 is disposed corresponding to the portion of the dust cap 12 where the sound wave of the vibration plate 11 does not generate. Then, the high-frequency speaker 20 does not interfere in the low-frequency sound wave which is generated by the vibration of the vibration plate 11.

The high-frequency speaker 20 outputs treble sound to the front from the center of the vibration plate 11. The high-frequency speaker 20 is placed at a predetermined distance away from the front state of the dust cap 12 so as to operate independently of the low-frequency speaker 10, by which the interference in the vibration of bass sound from the vibration plate 11 is minimized.

Further, the high-frequency speaker 20 may incorporate a tweeter in various features, such as a silk dome tweeter, a ribbon tweeter. Further, it is preferable that the diameter of the high-frequency speaker 20 is formed no greater than the diameter r2 of the dust cap 12. When the diameter of the high-frequency speaker 20 is formed smaller than the diameter r2 of the dust cap 12, the interference in the vibration of the vibration plate 11 may be avoided.

The protector 30 is placed at a predetermined distance away from the front state of the dust cap 12 so as to hold the high-frequency speaker 20 from the front. The protector 30 is formed so as to open the front side of the vibration plate 11 so that the interference in the bass sound from the vibration plate 11 may be minimized. For this purpose, the protector 30 comprises a holder portion 31, a bridge portion 32, and a rim ring 33.

The holder portion 31 is preferably formed in a shape of cylindrical hollow with its rear side opened and its front side closed. The high-frequency speaker 20 is inserted through the rear side so that the holder portion 31 surrounds the high-frequency speaker 20 from the front.

Further, it is preferable that the diameter r1 of the holder portion 31 is formed no greater than the diameter r2 of the dust cap 12, as same in the high-frequency speaker 20. That is, when the diameter r1 of the holder portion 31 is formed smaller than the diameter r2 of the dust cap 12, the interference in the vibration of the vibration plate 11 may be avoided.

The bridge portion 32 is configured so that one end protrudes radially from a side of the holder portion 31 with being connected integrally with the side of the holder portion 31, and further so that the other end is connected integrally with the inner side of the rim ring 33 of a donut shape. Pluralities of bridge portions 32 are disposed between the holder portion 31 and the rim ring 33 so that the bridge portions 32 may fix the holder portion 31 in a floating state when the rim ring 33 is mounted to the frame F of the 2-way speaker 1.

As shown in FIG. 4, the bridge portions 32 are made in a type of plate, and are arranged in thin and erected manner to the longitudinal direction of the vibration plate 11. By providing bridge portions 32 of thin plate shape and of erected manner as described above, the holder 31 may be rigidly connected with the rim ring 33 and the zone may be minimized where sound wave from the vibration plate 11 can be under interference.

Further, it is preferable that the bridge portions 32 are configured of a folded plate-shape with letting the power line L leading to the high-frequency speaker 20 to be sandwiched between the plates. In the present invention, the bridge portion 32 is made as thin as possible by configuring the bridge portion 32 in folded shape as described above, by which the interference in the vibration of bass sound from the vibration plate 11 may be minimized, and further by which the power line L may extend to the high-frequency speaker 20 so as to make the high-frequency speaker 20 to operate independently of the low-frequency speaker 10.

Further, the bridge portion 32 is formed of a large plate-shape in the longitudinal direction. Thee rear end of the bridge portion 32 which is adjacent to the rim ring 33 is cut to a predetermined depth into the front. Therefore, the surround portion 13 which protrudes to the front may be deposited on the bridge portion 32 without being distorted.

The rim ring 33 is connected integrally to the other end of the bridge portion 32 and is close to the front rim of the vibration plate 11 so as to anchor the holder portion 31 and the vibration plate 11 to the housing H. The reference numeral 50 in FIG. 5 indicates a plate to separate the voice coil and the magnet.

Figure 6:
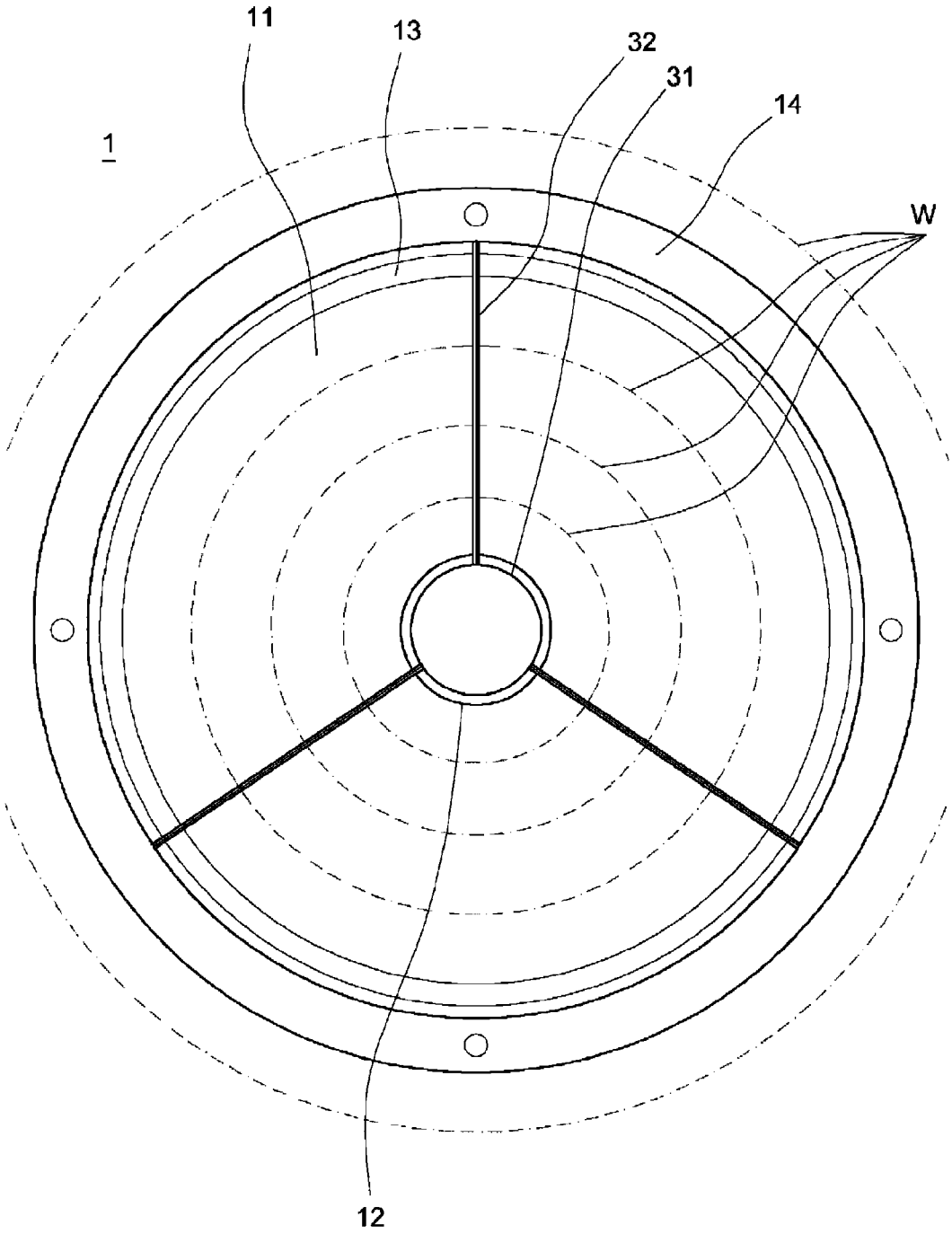
FIG. 6 a front view of the 2-way speaker with coaxial effect according to the first embodiment of the present invention.

FIG. 6 is a front view of the 2-way speaker with coaxial effect according to the first embodiment of the present invention. Referring to FIG. 6, the sound wave W is generated in the vibration plate 11 and then radially expands to the front, but not generated in area of the dust cap 12 which is disposed in the central portion of the vibration plate 11. That is, by configuring the diameter of the high-frequency speaker 20 and the holder portion 31 for holding the high-frequency speaker 20 smaller than the diameter of the dust cap 12, the sound wave W from the vibration plate 11 is not interfered by the high-frequency speaker 20 and the holder portion 31, which renders better extra-bass in the sound wave W.

Figure 7:
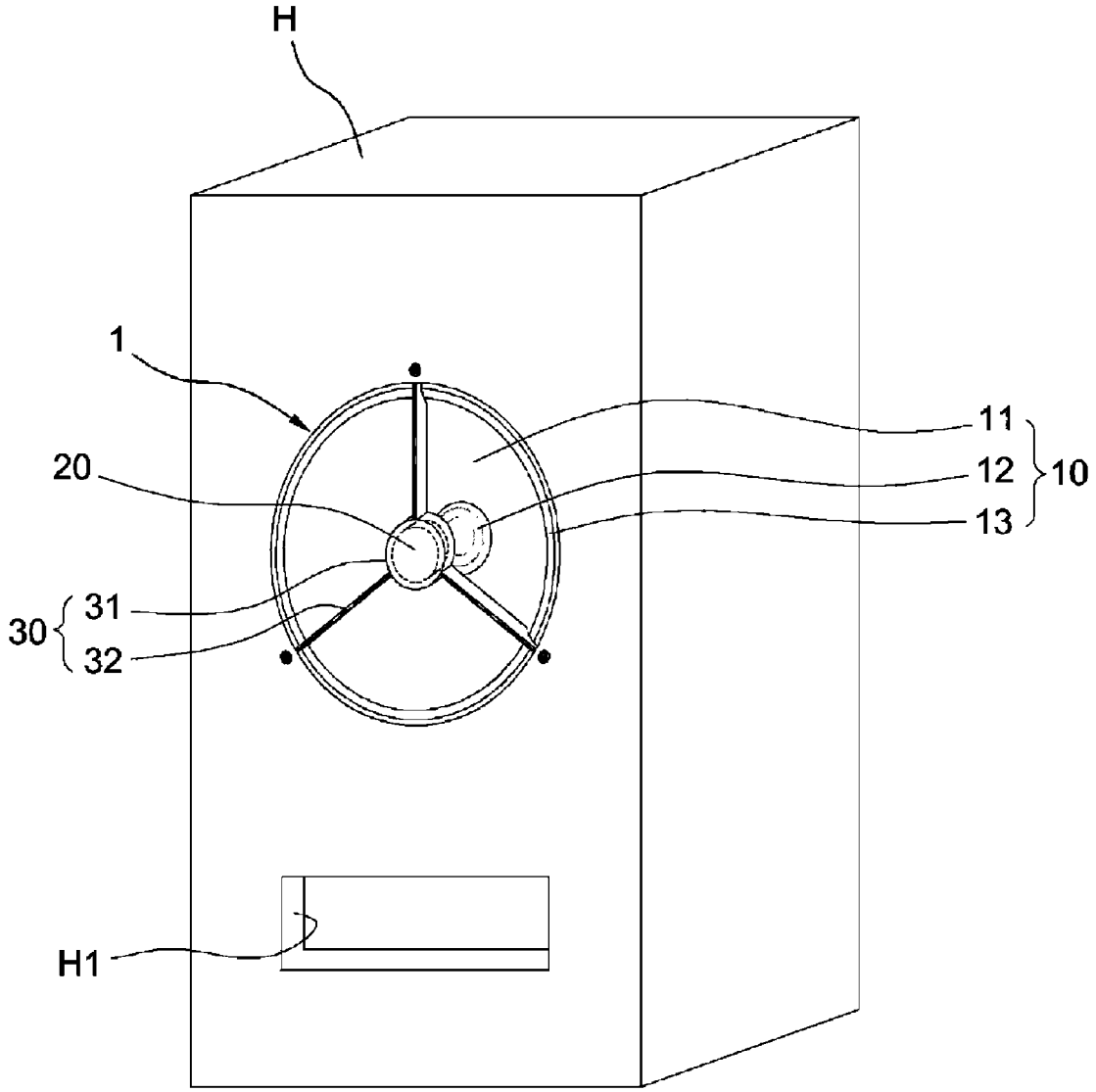
FIG. 7 shows a usage state of the 2-way speaker with coaxial effect according to a second embodiment of the present invention.
Figure 8:
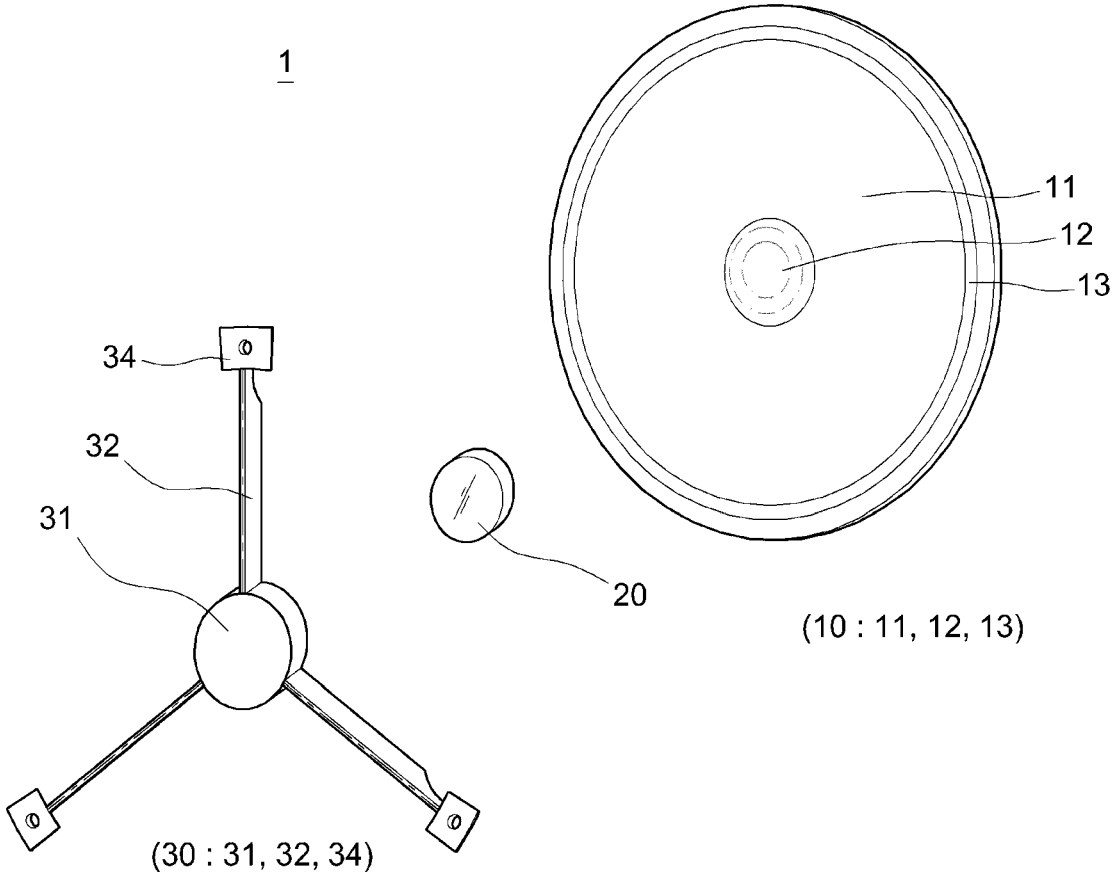
FIG. 8 is an exploded perspective view of the 2-way speaker with coaxial effect according to the second embodiment of the present invention.
Figure 9:
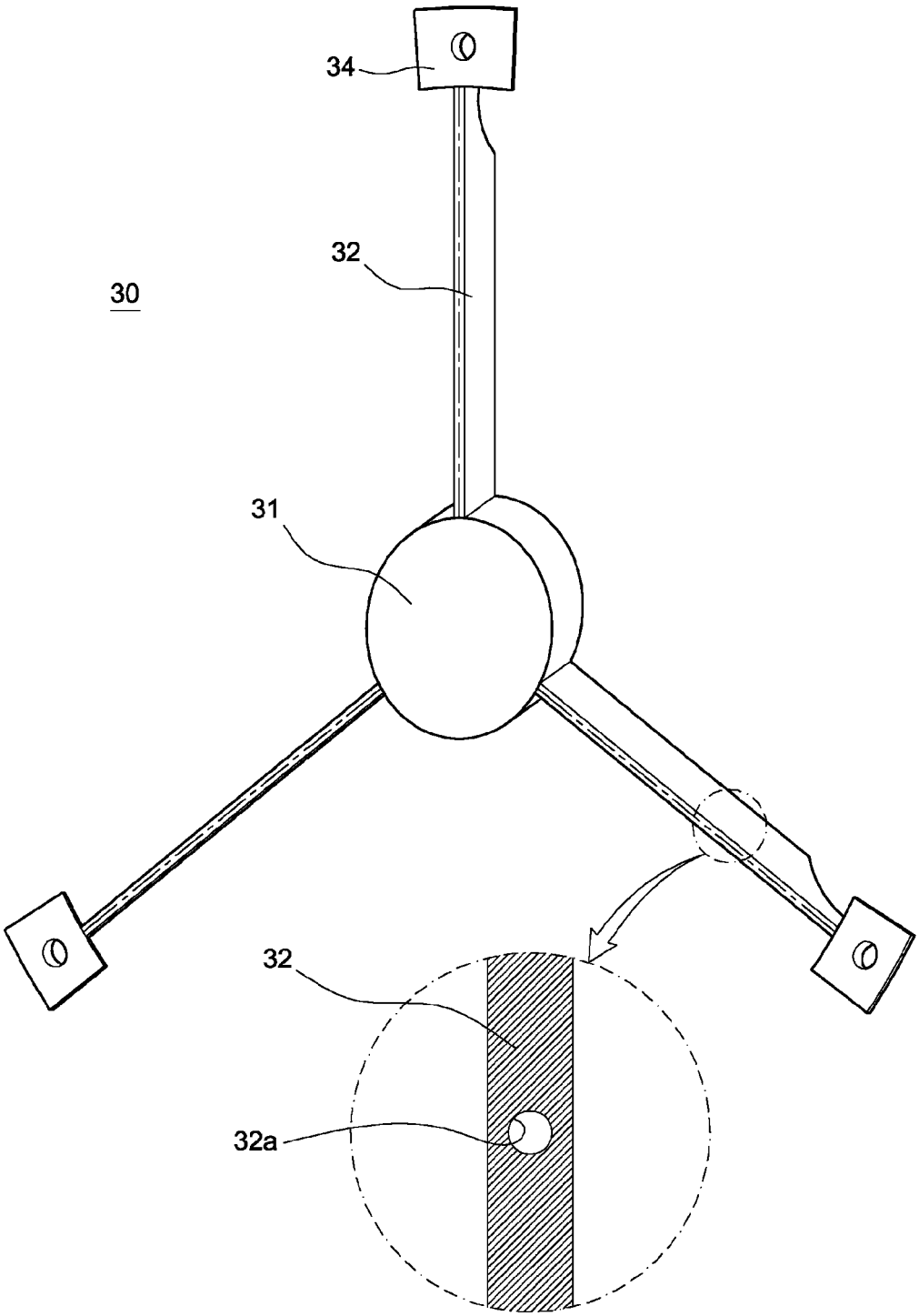
FIG. 9 shows a perspective view and an enlarged view of a part of a protector according to the second embodiment of the present invention.
Figure 10:
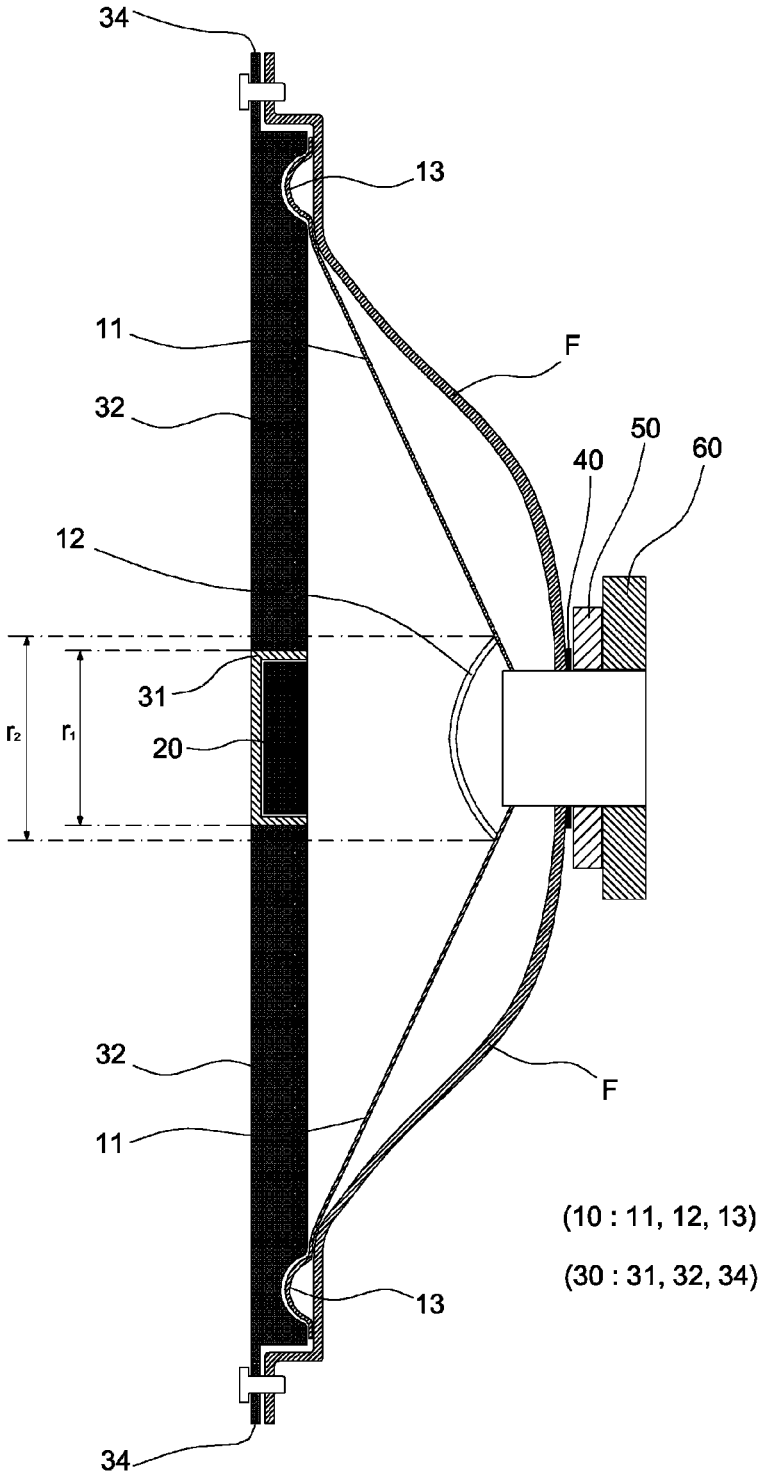
FIG. 10 is a cross-sectional side view of the 2-way speaker with coaxial effect according to the second embodiment of the present invention.

FIG. 7 shows a usage state of the 2-way speaker with coaxial effect according to a second embodiment of the present invention. FIG. 8 is an exploded perspective view of the 2-way speaker with coaxial effect according to the second embodiment of the present invention. FIG. 9 shows a perspective view and an enlarged view of a part of a protector according to the second embodiment of the present invention. FIG. 10 is a cross-sectional side view of the 2-way speaker with coaxial effect according to the second embodiment of the present invention.

Referring to FIGS. 7 to 10, in the 2-way speaker with coaxial effect according to the second embodiment of the present invention, the protector 30 comprises a holder portion 31, a bridge portion 32, and a fixing bracket 34.

The holder portion 31 of the second embodiment of the present invention is formed in a shape of cylindrical hollow with its rear side opened and its front side closed. The high-frequency speaker 20 is inserted through the rear side so that the holder portion 31 surrounds the high-frequency speaker 20 from the front, as same in the first embodiment. Further, it is preferable that the diameter r1 of the holder portion 31 is formed no greater than the diameter r2 of the dust cap 12, as same in the high-frequency speaker 20. That is, when the diameter r1 of the holder portion 31 is formed smaller than the diameter r2 of the dust cap 12, the interference in the vibration of the vibration plate 11 may be avoided.

The bridge portion 32 is configured so that one end protrudes radially from a side of the holder portion 31 with being connected integrally with the side of the holder portion 31, and further so that the other end is connected with the fixing bracket 34. The bridge portion 32 and the fixing bracket 34 may be configured as one body or may be connected by soldering, etc. Pluralities of bridge portions 32 are disposed between the holder portion 31 and the fixing bracket 34 so that the bridge portions 32 may fix the holder portion 31 in a floating state when the fixing bracket 34 is mounted to the frame F of the 2-way speaker 1.

As shown in FIG. 9, the bridge portions 32 are made in a type of plate, and are arranged in thin and erected manner to the longitudinal direction of the vibration plate 11. By providing bridge portions 32 of thin plate shape and of erected manner as described above, the holder 31 may be rigidly connected with the fixing bracket 34 and the zone may be minimized where sound wave from the vibration plate 11 can be under interference.

Further, it is preferable that a through hole 32*a* is formed in the inner longitudinal section along the bridge portion 32 with letting the power line L leading to the high-frequency speaker 20 to be fitted in the through-hole 32*a*. The bridge portion 32 is made as thin as possible by configuring the bridge portion 32 in plate shape as described above, by which the interference in the vibration of bass sound from the vibration plate 11 may be minimized, and further by which the power line L may extend to the high-frequency speaker 20 so as to make the high-frequency speaker 20 to operate independently of the low-frequency speaker 10.

Further, the bridge portion 32 is formed of a large plate-shape in the longitudinal direction. Thee rear end of the bridge portion 32 which is adjacent to the fixing bracket 34 is cut to a predetermined depth into the front. Therefore, the surround portion 13 which protrudes to the front may be deposited on the bridge portion 32 without being distorted.

The fixing bracket 34 is connected integrally to the other end of the bridge portion 32 and is close to the front rim of the vibration plate 11 so as to anchor the holder portion 31 and the vibration plate 11 to the housing H.

The invention claimed is:

1. A two-way speaker with coaxial effect, comprising:

a low-frequency speaker including a vibration plate being formed of disk shape with its central portion recessed to a rear and for outputting bass sound to a front, a dust cap being fitted in the front central portion of the vibration plate so as to block an inside of the vibration plate from an outside, and a surround portion of protruding to a front in a donut shape along a front rim of the vibration plate and for outputting surround-sound;

a high-frequency speaker for outputting treble sound to the front in the center of the vibration plate and of being placed at a predetermined distance away from the front state of the dust cap so as to operate independently of the low-frequency speaker by which the interference in the vibration of bass sound from the vibration plate is minimized; and a protector of being placed at a predetermined distance away from the front state of the dust cap so as to hold the high-frequency speaker from the rear and of being formed to open the front side of the vibration plate by which the interference in the bass sound from the vibration plate being minimized, wherein the protector including a holder portion for holding the high-frequency speaker with surrounding the high-frequency speaker from the front, and a plurality of bridge portions of protruding radially from a side of the holder portion with having one end being connected integrally with the side of the holder portion and of being configured of a folded plate-shape with letting the power line leading to the high-frequency speaker to be sandwiched between the plates.

2. The two-way speaker with coaxial effect of the claim 1, which is characterized in that the protector further comprises a rim ring being connected integrally to the other end of the bridge portion and being close to the front rim of the vibration plate so as to anchor the holder portion to the vibration plate.

3. The two-way speaker with coaxial effect of the claim 2, which is characterized in that the diameter of the holder portion is formed no greater than the diameter of the dust cap.

4. The two-way speaker with coaxial effect of the claim 2, which is characterized in that a through hole is formed in the inner longitudinal section along the bridge portion and the power supply line leading to the high-frequency speaker is fitted in the through hole.

5. The two-way speaker with coaxial effect of the claim 4, which is characterized in that the bridge portion has rear end corresponding to the surround portion being cut to the front by a predetermined depth.

6. The two-way speaker with coaxial effect of the claim 2, which is characterized in that the bridge portion has rear end corresponding to the surround portion being cut to the front by a predetermined depth.

* * * * *